US008734597B2

(12) United States Patent
Kim et al.

(10) Patent No.: US 8,734,597 B2
(45) Date of Patent: May 27, 2014

(54) SEGMENTAL ULTRASONIC CLEANING APPARATUS FOR REMOVING SCALES AND SLUDGE ON TOP OF TUBE SHEET IN HEAT EXCHANGER

(75) Inventors: Seok Tae Kim, Daejeon (KR); Woo Tae Jeong, Daejeon (KR); Hee Geun Kim, Daejeon (KR); Tae Young Kong, Daejeon (KR)

(73) Assignee: Korea Hydro & Nuclear Power Co., Ltd., Seoul (KR)

( * ) Notice: Subject to any disclaimer, the term of this patent is extended or adjusted under 35 U.S.C. 154(b) by 821 days.

(21) Appl. No.: 12/891,683

(22) Filed: Sep. 27, 2010

(65) Prior Publication Data

US 2012/0055521 A1 Mar. 8, 2012

(30) Foreign Application Priority Data

Sep. 6, 2010 (KR) ..... 10-2010-0086896

(51) Int. Cl.
*F28G 7/00* (2006.01)

(52) U.S. Cl.
USPC ..... 134/167 R; 134/168 R; 134/184; 134/201; 376/310; 376/316

(58) Field of Classification Search
USPC ..... 134/172, 167 R, 168 R, 184; 376/310, 376/316; 15/363, 379
See application file for complete search history.

(56) References Cited

U.S. PATENT DOCUMENTS

| | | | | |
|---|---|---|---|---|
| 2,957,994 | A * | 10/1960 | Dickey | 310/26 |
| 4,424,769 | A * | 1/1984 | Charamathieu et al. | 122/392 |
| 5,305,361 | A * | 4/1994 | Enomoto et al. | 376/316 |
| 5,411,043 | A * | 5/1995 | Kamler | 134/167 R |
| 5,514,219 | A * | 5/1996 | Kamler | 134/22.1 |
| 5,913,320 | A * | 6/1999 | Varrin et al. | 134/22.18 |
| 6,290,778 | B1 * | 9/2001 | Zugibe | 134/1 |
| 2005/0092354 | A1 * | 5/2005 | Jeong et al. | 134/180 |
| 2006/0107975 | A1 * | 5/2006 | Arguelles et al. | 134/56 R |

* cited by examiner

*Primary Examiner* — Michael Barr
*Assistant Examiner* — Kevin G Lee
(74) *Attorney, Agent, or Firm* — Edwards Wildman Palmer LLP; Kongsik Kim; Stephen D. LeBarron

(57) ABSTRACT

Disclosed herein is a segmental ultrasonic cleaning apparatus configured to remove scales and/or sludge deposited on a tube sheet. The segmental ultrasonic cleaning apparatus includes a plurality of segment groups arranged in a ring shape on a top surface of a tube sheet along an inner wall of the steam generator, in which each of the segment groups includes an ultrasonic element segment and a guide rail support segment loosely connected to each other by metal wires through hand holes located at a lower portion of the steam generator, such that ultrasound waves radiated from an ultrasonic transducer in each of the ultrasonic element segments travels along the surface of the tube sheet, with the segment groups tightly connected in the ring shape by tightening the metal wires via wire pulleys of flange units.

5 Claims, 14 Drawing Sheets

SEGMENTAL ULTRASONIC CLEANING APPARATUS FOR REMOVING SCALES AND SLUDGE ON TOP OF TUBE SHEET IN HEAT EXCHANGER

BACKGROUND OF THE INVENTION

1. Field of the Invention

The present invention relates to a segmental ultrasonic cleaning apparatus capable of removing scales and sludge in a heat exchanger using ultrasound waves and, more particularly, to a segmental ultrasonic cleaning apparatus configured to remove scales and/or sludge deposited on a top surface of a tube sheet, which supports tubes of a steam generator in a nuclear power plant, through concentration of ultrasound energy on the top surface of the tube sheet.

2. Description of the Related Art

Typically, scales and/or sludge are deposited on a tube surface and a tube sheet supporting tubes of a commercial heat exchanger during heat exchange, as is known in the art. Particularly, despite continuous management of quality of reactor water flowing into a steam generator in a nuclear power plant, metallic scales and/or sludge are deposited in the steam generator, thereby causing deterioration in heat exchange efficiency affecting output of the nuclear power plant as well as corrosion of the steam generator which results in a reduction of the life cycle of the steam generator.

Therefore, for the nuclear power plant, it is necessary to perform periodic cleaning of the steam generator. Currently, the cleaning method for the steam generator is generally classified into chemical cleaning and high-pressure water jet cleaning. Chemical cleaning permits cleaning of the entirety of the steam generator. However, since chemical cleaning entails considerable cleaning costs and causes chemical damage to the steam generator in addition to consuming large amounts of water, the chemical cleaning is performed only when necessary. On the other hand, high-pressure water jet cleaning is performed once per scheduled overhaul to remove scales and/or sludge deposited on top of a tube sheet in the steam generator. However, the high-pressure water jet cleaning typically permits cleaning of only a region that high-pressure jet water can reach. For example, a steam generator of a Korean standard nuclear power plant includes more tubes than other types of steam generators, such that a distance between the tubes is very narrow, thereby forming a shadow zone which some of the high-pressure water cannot reach during high-pressure water jet cleaning, thereby deteriorating cleaning efficiency.

In the nuclear power plant, ultrasonic elements are often used to clean the steam generator. In this case, with the steam generator filled with water or a liquid cleaning agent, the ultrasonic elements are immersed therein to remove scales and/or sludge from the top surface of the tube sheet via ultrasonication. Typically, due to the characteristics of ultrasound waves, the ultrasound waves are propagated to a portion contacting the liquid. Thus, when using the ultrasonic elements to clean the steam generator, there is a problem in that the range of the ultrasound waves is increased but the energy density of the ultrasound waves is significantly lowered as the distance from a source of the ultrasound waves increases.

SUMMARY OF THE INVENTION

The present invention is conceived to solve the above problems of the related art.

One aspect of the present invention is to provide a segmental ultrasonic cleaning apparatus configured to remove scales and/or sludge deposited on a top surface of a tube sheet in a heat exchanger or steam generator through concentration of ultrasound energy on the surface of the tube sheet.

To concentrate ultrasound energy on the surface of the tube sheet in the steam generator, the segmental ultrasonic cleaning apparatus is configured to achieve effective removal of scales and/or sludge on the top surface of the tube sheet in the heat exchanger or steam generator through propagation of ultrasound waves based on a principle of generating surface waves.

Further, the segmental ultrasonic cleaning apparatus includes a plurality of segment groups arranged in a ring shape on the top surface of the tube sheet along an inner wall of the steam generator, in which each of the segment groups includes an ultrasonic element segment and a guide rail support segment loosely connected to each other by metal wires through hand holes located at a lower portion of the steam generator, such that ultrasound waves radiated from an ultrasonic transducer in each of the ultrasonic element segments travels along the surface of the tube sheet, with the segment groups tightly connected in the ring shape by tightening the metal wires via wire pulleys of flange units.

In accordance with one aspect of the invention, a segmental ultrasonic cleaning apparatus includes: guide rails each having a parallelepiped shape and formed with a through-hole in a longitudinal direction; ultrasonic element segments each including an ultrasonic transducer disposed on one side of one guide rail, the ultrasonic transducer including a radiating plate, a magnetostrictive material pack, a magnetic field coil and an angle adjustor; guide rail support segments each including a support plate disposed on one side of another guide rail, the support plate having a leg and a wheel provided to a lower side of the leg; a metal wire to be guided along through-holes formed in the guide rails; and a flange unit provided to a hand hole of the heat exchanger or steam generator, and including a flange provided to the hand hole, a wire pulley securing one end of the metal wire, and guide rail couplers connected to the guide rails disposed at opposite sides, wherein a plurality of segment groups each comprising at least one guide rail support segment and at least one ultrasonic element segment with the radiating plate of the ultrasonic transducer slanted at a certain angle to the tube sheet are arranged in a line via the metal wire on the top surface of the tube sheet along an inner wall of the heat exchanger or steam generator.

The radiating plate of the ultrasonic transducer may be slanted towards a center of the top surface of the steam generator at a certain angle relative to the tube sheet of the steam generator.

BRIEF DESCRIPTION OF THE DRAWINGS

The above and other features of the invention will become apparent from the following detailed description in conjunction with the accompanying drawings, in which.

DETAILED DESCRIPTION OF THE EMBODIMENTS

Embodiments of the invention will now be described in more detail with reference to the accompanying drawings.

Figure 1:
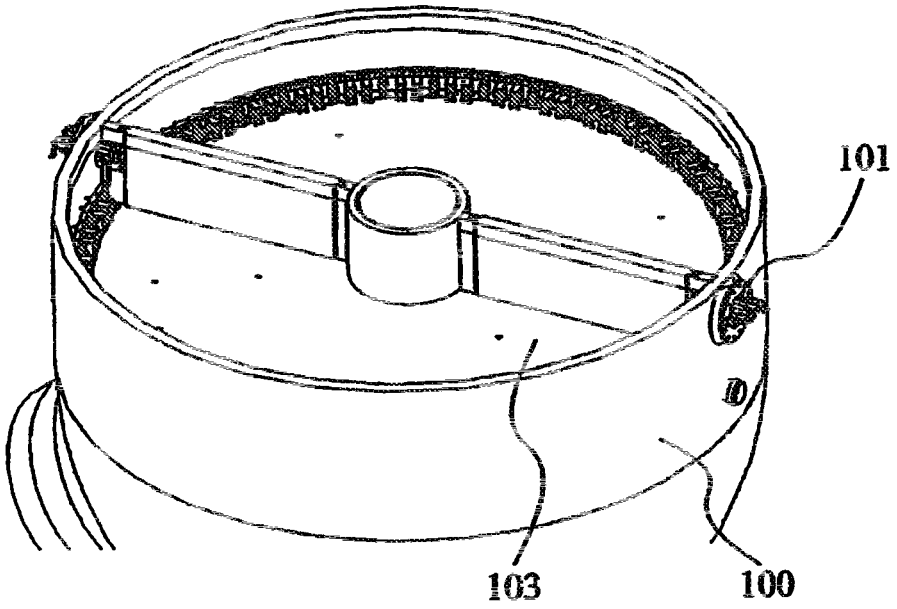
FIG. 1 shows an inner configuration of a steam generator including a segmental ultrasonic cleaning apparatus according to an embodiment of the present invention.
Figure 2:
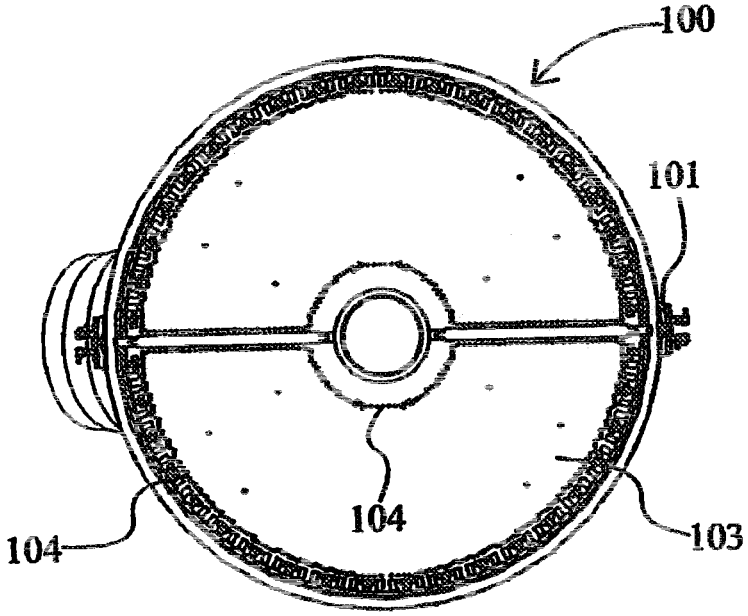
FIG. 2 is a top view of the steam generator including the segmental ultrasonic cleaning apparatus of FIG. 1.

FIG. 1 shows an inner configuration of a steam generator including a segmental ultrasonic cleaning apparatus according to an embodiment of the present invention, and FIG. 2 is a top view of the steam generator including the segmental ultrasonic cleaning apparatus of FIG. 1. For reference, a steam generator 100 includes a tube sheet 103 at an upper portion thereof and a plurality of tubes 104 penetrating the tube sheet 103. In FIG. 2, only the tubes 104 are shown along an edge of the tube sheet 103 to aid in understanding of components constituting an ultrasonic cleaning apparatus according to an embodiment of the invention (for reference, the tubes are omitted in FIG. 1).

As shown in FIG. 1, the ultrasonic cleaning apparatus according to the embodiment is designed to remove scales and/or sludge deposited on a top surface of the tube sheet 103 in the steam generator 100. To this end, the ultrasonic cleaning apparatus includes a plurality of segment groups connected in a line by tools such as metal wires to be arranged along an inner wall of the steam generator 100, in which each segment group is formed by attaching an ultrasonic transducer and guide rail support plates to guide rails, which are arranged with the same diameter as that of the inner wall of the steam generator 100.

Figure 3:
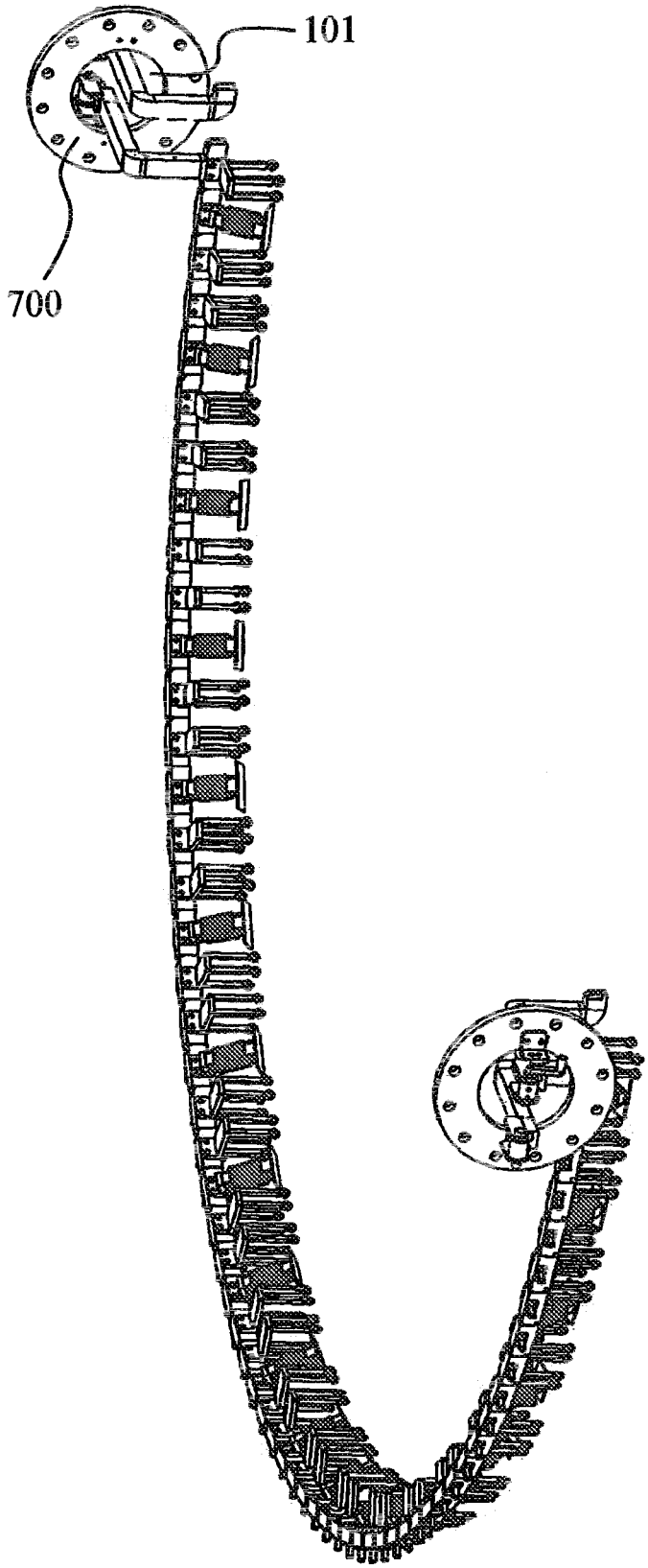
FIG. 3 is a perspective view of the segmental ultrasonic cleaning apparatus according to the embodiment of the present invention.

Referring to FIG. 3, the plurality of segment groups connected to each other by the metal wires are curvedly inserted into the steam generator 100 through hand holes 101 of the steam generator 100 and are then brought into close contact with each other without a clearance therebetween by tightening the metal wires with flange units 700, which are provided to the hand holes 101 of the steam generator 100, so that the plurality of segment groups are positioned parallel to the inner wall of the steam generator 100.

Figure 4:
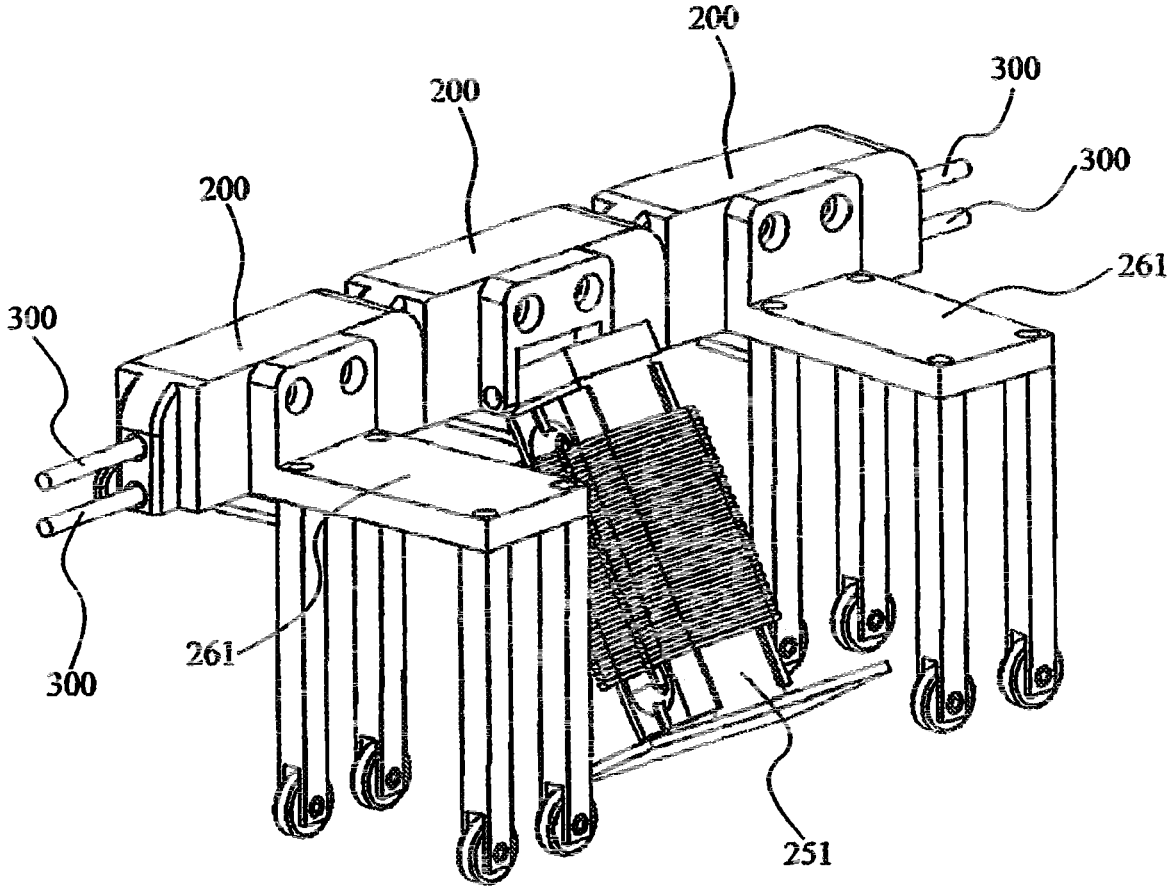
FIG. 4 is a partially enlarged view of the segmental ultrasonic cleaning apparatus of FIG. 3, in which a segment group is composed of a single ultrasonic element segment and two guide rail support segments.

FIG. 4 is a partially enlarged view of the segmental ultrasonic cleaning apparatus of FIG. 3, in which a segment group is composed of a single ultrasonic element segment and two guide rail support segments.

An ultrasonic transducer or a support plate 261 may be selectively attached to one side of the guide rail 200, preferably towards the center of the steam generator.

Herein, the term "ultrasonic element segment" refers to an instrument that is formed by attaching an ultrasonic transducer 251 to one guide rail 200 and may generate ultrasound waves in water, aqueous solution or liquid cleaning agent on the tube sheet in the steam generator to remove scales and/or sludge. Further, the term "guide rail support segment" refers to an instrument that is formed by attaching a support plate 261 to another guide rail 200 and may maintain a constant distance between the inner wall of the steam generator and the tube sheet while allowing easy movement of the support plate 261 on the tube sheet inside the steam generator.

In FIG. 4, each segment group is composed of a single ultrasonic element segment 250 (see FIG. 10) and two guide rail support segments 260 (see FIG. 13), and the segment groups are arranged in a line via the metal wires 300 to have a ring shape similar to the shape of the inner wall of the steam generator, as shown in FIG. 3.

In the embodiment shown in FIG. 4, each of the segment groups of the segmental ultrasonic cleaning apparatus includes the single ultrasonic element segment and the two guide rail support segments. However, it should be understood that the segment group is not limited to this arrangement. In other words, the segment group of the segmental ultrasonic cleaning apparatus may have a variety of arrangements in consideration of convenience in use, such as a segment group comprising a single ultrasonic element segment and a single guide rail support segment, a segment group comprising two single ultrasonic element segments and a single guide rail support segment, and the like.

Figure 5:
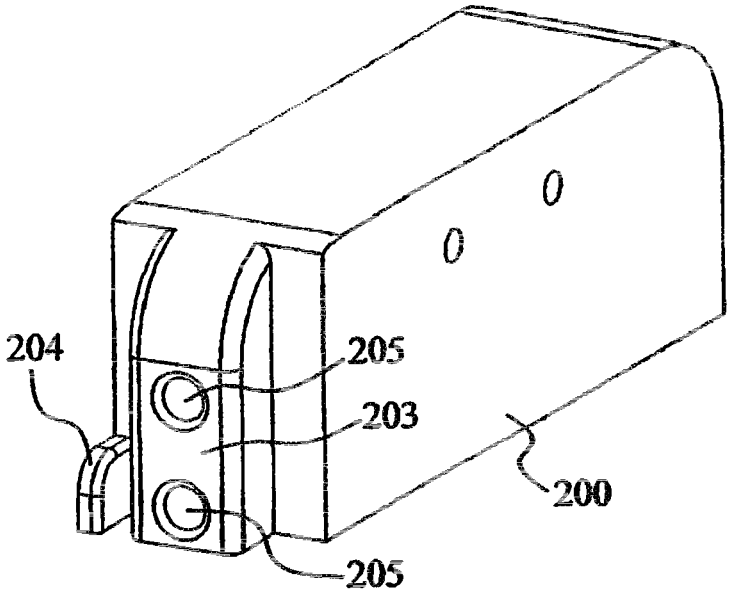
FIGS. 5, 6 and 7 are perspective views of a guide rail provided to each segment, respectively.
Figure 6:
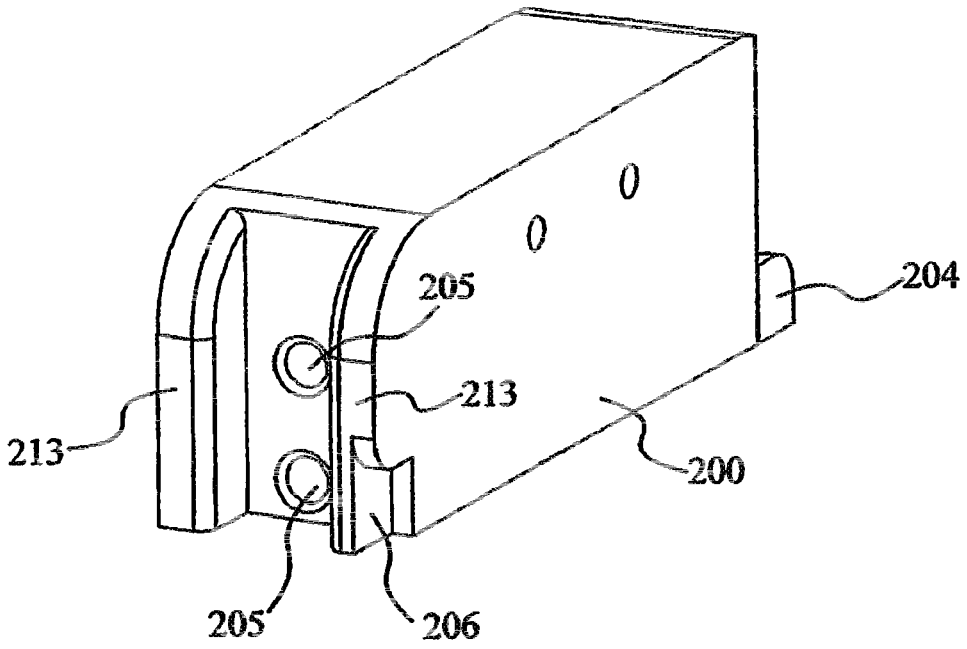
Figure 7:
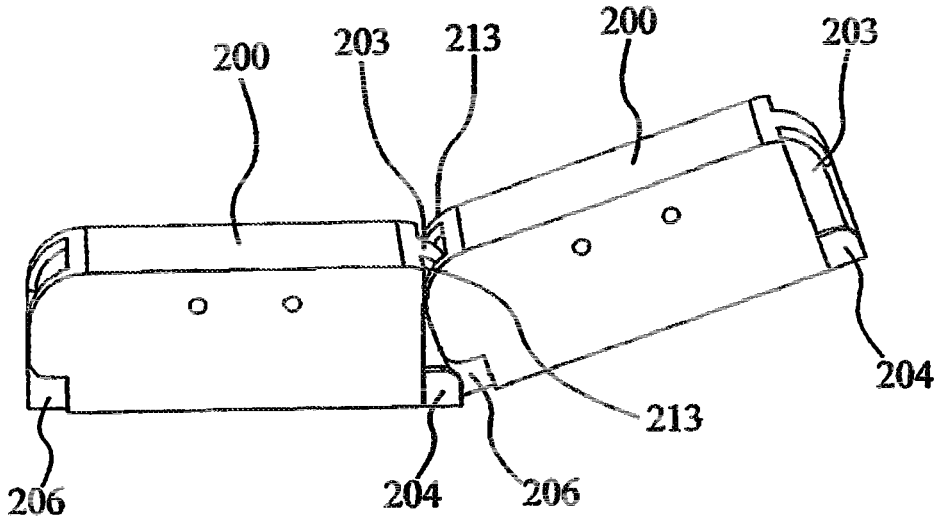

FIGS. 5, 6 and 7 are perspective views of a guide rail provided to each segment, respectively. Particularly, FIG. 5 is a perspective view of the guide rail viewed at the left side, FIG. 6 is a perspective view of the guide rail viewed at the right side, and FIG. 7 is a perspective view of two guide rails arranged in a line.

The guide rail 200 generally has a parallelepiped shape, and in particular, right and left sides of the guide rail 200 have shapes corresponding to each other so as to engage with each other.

In other words, the left side of the guide rail 200 includes a single projection 203 longitudinally formed at a center of the left side of the guide rail 200, a protrusion 204 separate from the projection 203 and formed at a left lower edge of the guide rail 200, and two through-holes 205 longitudinally formed through the guide rail 200. On the other hand, the right side of the guide rail 200 includes two projections 213 longitudinally formed parallel to each other at opposite ends of the right side of the guide rail 200, a groove 206 formed at a lower side of the projections 213 to receive the protrusion 204, and the two through-holes 205. The through-holes 205 are longitudinally formed in the guide rail 200 from the left side to the right side of the guide rail 200, such that the metal wires connect the guide rails 200 arranged in a line through the through-holes 205.

The projections 203 of the right side and the projection 213 and protrusion 204 of the left side are chamfered to have rounded upper edges, and the groove 206 is also chamfered to have a rounded upper edge.

With this configuration, when the guide rails 200 are arranged parallel to each other, the protrusion 204 on the left side of a first guide rail 200 is seated on the groove 206 formed at the lower side of the projections 213 on the right side of a second guide rail 200, while the projection 203 on the left side of the first guide rail 200 is positioned between the two projections 210 on the right side of the second guide rail 200. In particular, as shown in FIG. 7, the chamfered upper edges of the respective components of the guide rails 200 prevent the guide rails 200 from being bent downward while allowing the guide rails 200 to be easily bent upward.

The metal wires pass through the through-holes 205 of the guide rails 200 to connect the guide rails 200 in a line, and the guide rails 200 connected in a line by the metal wires may be bent to be inserted into the steam generator 100 through the hand holes 101 of the steam generator (see FIGS. 3 and 4).

Optionally, the guide rail 200 includes a spacer 207 on a side surface of the guide rail 200 facing the inner wall of the steam generator to maintain a constant distance between the guide rail and the steam generator, and a ball bearing 208 on a distal end of the spacer 207. The ball bearing 208 is conducive to movement of the guide rail by reducing friction between the guide rail and the inner wall of the steam generator during installation of the guide rail (see FIG. 13).

Figure 8:
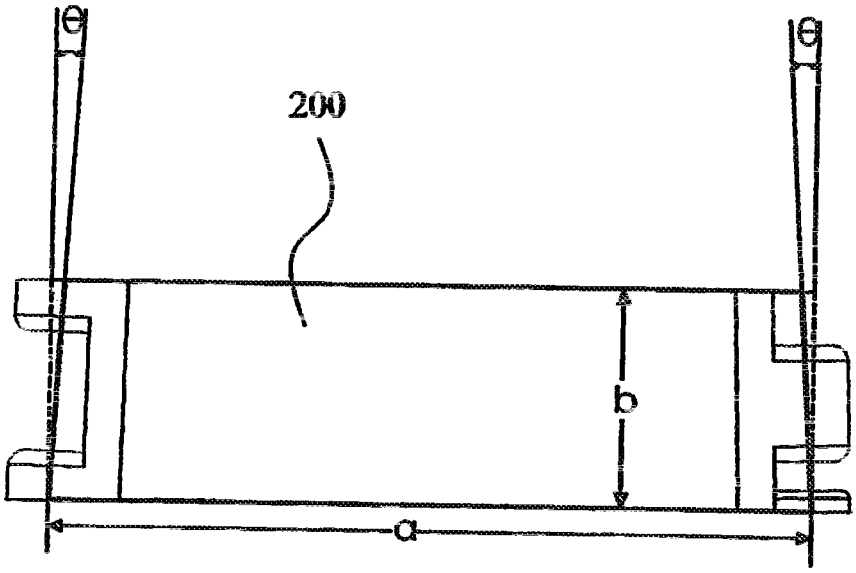
FIG. 8 is a top view of the guide rail.

FIG. 8 is a top view of the guide rail, which allows the segmental ultrasonic cleaning apparatus according to the embodiment to be arranged in a ring similar to the inner configuration of the steam generator. Here, a curvature angle θ is applied to either side of the guide rail.

For the segmental ultrasonic cleaning apparatus according to the embodiment, the guide rails 200 are arranged in the ring shape corresponding to the inner wall of the steam generator. Specifically, the guide rails 200 are connected in a ring shape by the metal wires to have a specific curvature, preferably, a curvature by which the guide rails are arranged parallel to the inner wall of the steam generator. When viewed from an upper side, each of the guide rails 200 may have an isosceles trapezoidal shape, in which rear and front sides of each of the guide rails 200 facing the inner wall and center of the steam generator are parallel to each other and right and left sides of the guide rail 200 are slanted at a specific angle θ.

Figure 9:
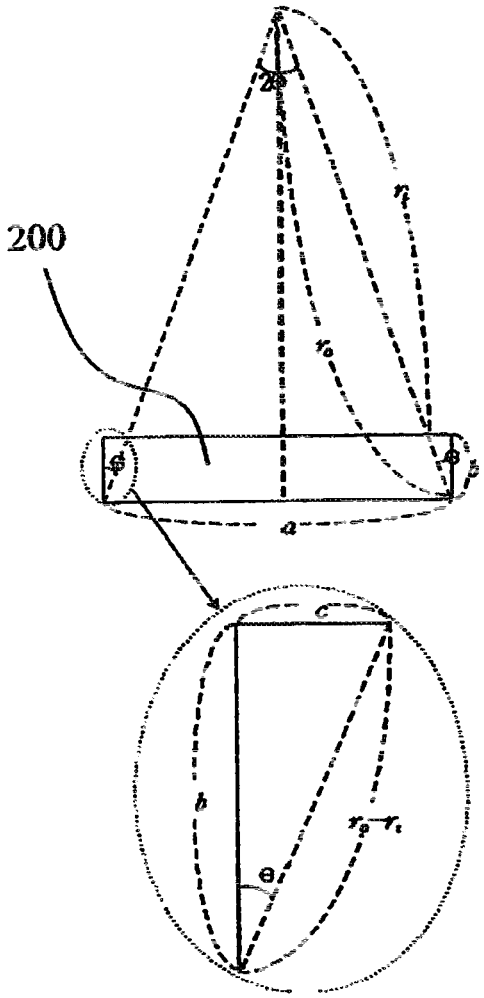
FIG. 9 is a diagram for calculation of dimensions of an isosceles trapezoidal guide rail shown in FIG. 8.

Referring to FIG. 9, the length "a" and the width "b" of each guide rail may be calculated based on figures drawn between the guide rail and the center of the steam generator.

In the following equations, "a" indicates the length of the guide rail extending in the longitudinal direction of the guide rail, and "b" indicates the width of the guide rail. "θ" indicates an angle of inclination for providing a curvature to the right and left sides of the guide rail, $r_0$ indicates a radius corresponding to the longest distance from a center of the guide rails arranged in the ring shape to a point of the guide rail (for example, either end point on the rear side of the guide rail), and $r_i$ indicates an inner radius relating to a thickness of the guide rail.

When a certain angle θ is provided to the guide rail, the length "a" of the guide rail 200 may be calculated by Equation 1:

$$a \cong r_0 \times 2(\theta[\text{rad}]) = r_0 \times 2\left(\theta[°] \times \frac{\pi}{180}\right)$$

Further, when a certain angle θ is provided to the guide rail, the width "b" of the guide rail 200 may be calculated by Equation 2:

$$\cos\theta = \frac{b}{(r_0 - r_i)}$$

$$b = (r_0 - r_i)\cos\theta$$

From Equations 1 and 2, it is possible to calculate the length "a" and the width "b" of the guide rail based on parameters, such as the outermost length "$r_0$" of the guide rail from the center of the steam generator, the innermost length "$r_i$" of the guide rail from the center of the steam generator, and the angle "θ".

For example, assuming $r_0$=1970 mm, $r_i$=1940 mm, and θ=1.5 degrees, it is determined by Equations 1 and 2 that each of the guide rails has a length "a" of 103.15 mm and a width "b" of 30 mm.

Additionally, since the respective segments having such guide rails are guided to the hand holes of the steam generator, the dimensions of the guide rail may be dependent on the size of the hand holes.

Next, the ultrasonic element segment of the ultrasonic cleaning apparatus according to the embodiment will be described.

Figure 10:
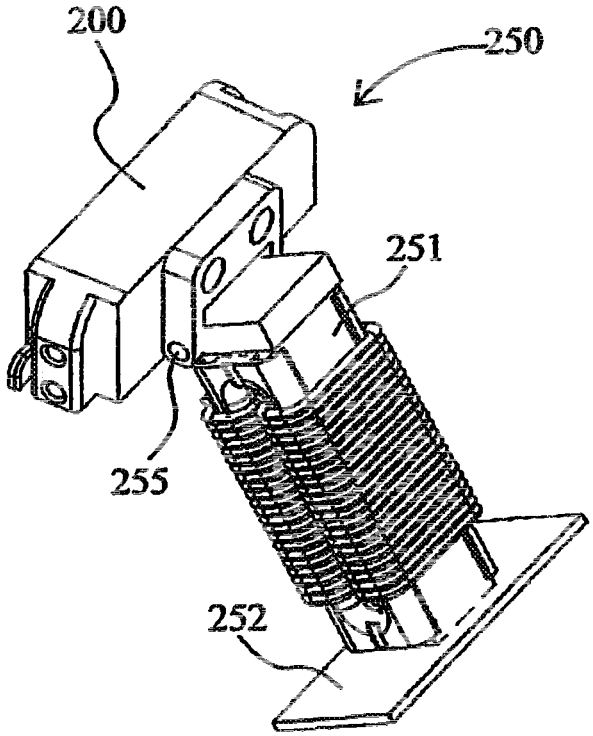
FIG. 10 is a perspective view of an ultrasonic element segment according to an embodiment of the present invention.
Figure 11:
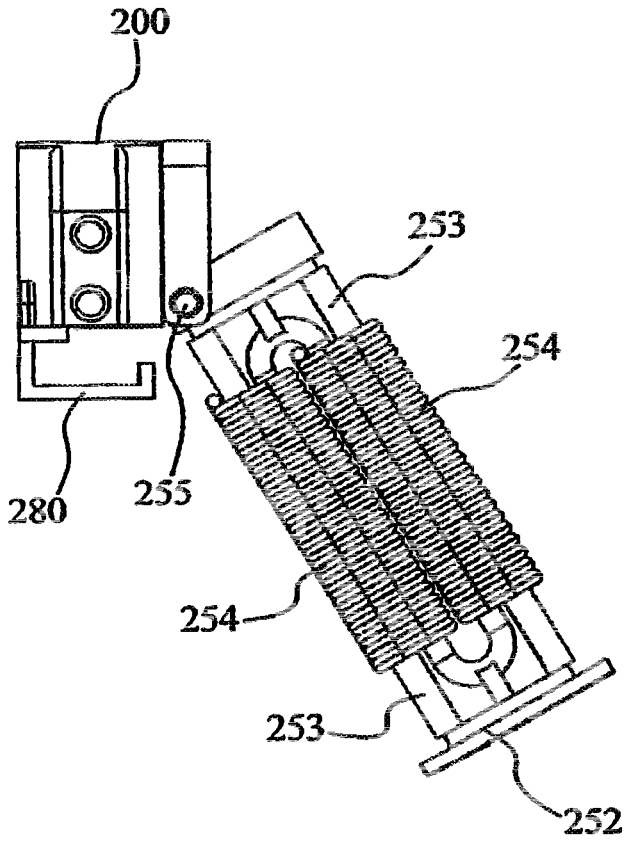
FIG. 11 is a left side view of the ultrasonic element segment of FIG. 10.

Referring to FIGS. 10 and 11, the ultrasonic element segment 250 of the ultrasonic cleaning apparatus includes the ultrasonic transducer 251 on one side of the guide rail 200, as described above.

Namely, the ultrasonic transducer 251 is mounted on one side of the guide rail 200 to be slanted at a certain angle with respect to the top surface of the tube sheet disposed across the steam generator. The ultrasonic transducer 251 may be coupled to the one side of the guide rail 200 by screw fastening or other methods to facilitate attachment and detachment of the ultrasonic transducer to the guide rail.

The ultrasonic transducer 251 includes a radiating plate 252, a magnetostrictive material pack 253, a magnetic field coil 254, and an angle adjustor 255. The ultrasonic transducer 251 generates ultrasound waves through magnetostriction of a magnetostrictive material to vibrate the radiating plate 252 when electric current passes through the magnetic field coil 254 wound around the magnetostrictive material pack 253. The ultrasonic transducer 251 is well known to a person having ordinary knowledge in the art and a detailed description thereof will be omitted herein.

When ultrasound waves are radiated from the radiating plate 252 of the ultrasonic transducer 251 to a liquid on the tube sheet in the steam generator, the ultrasound waves collide with the tube sheet at a particular angle β and generate ultrasound energy by generating surface waves along the surface of the tube sheet according to Snell's law.

In order to adjust and maintain the particular angle between the radiating plate 252 at a lower side of the ultrasonic transducer 251 and the tube sheet of the steam generator, the ultrasonic element segment 250 includes the angle adjustor 255 between the guide rail 200 and the ultrasonic transducer 251.

In addition, the guide rail 200 is provided on a lower surface thereof with a hook 280, which is used to align and arrange electric lines of the ultrasonic transducer 251.

Figure 12:
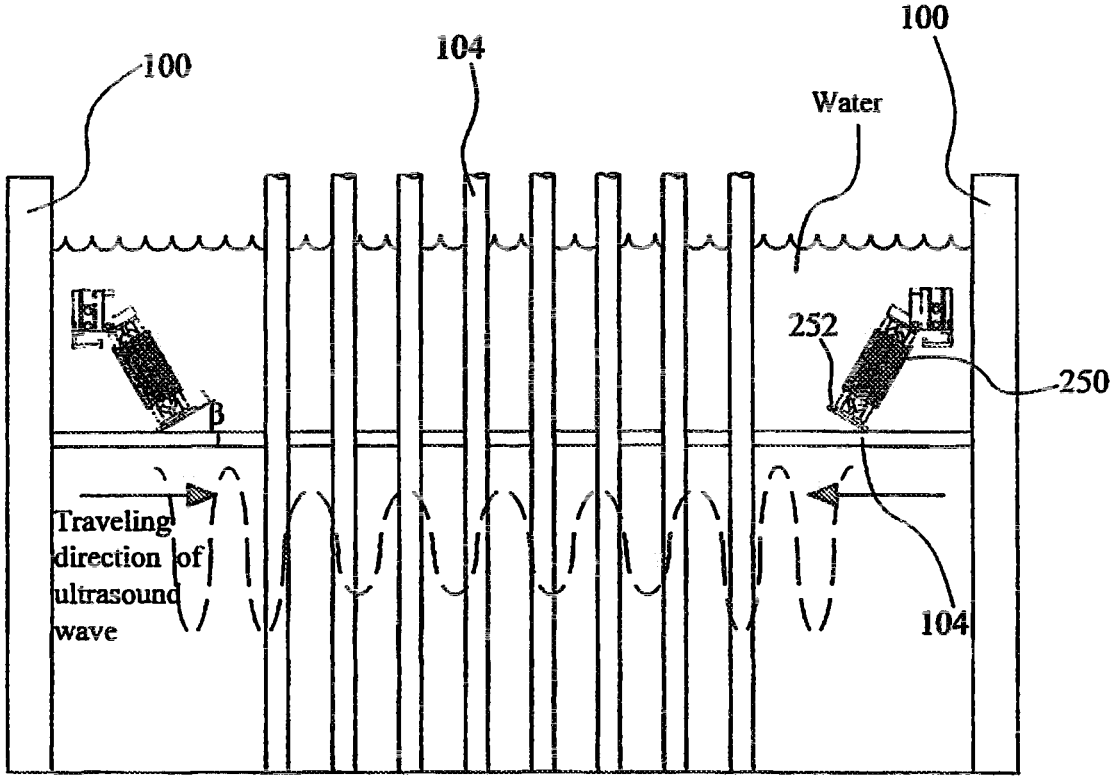
FIG. 12 is a schematic view of arrangement of the ultrasonic element segment and a tube sheet of a steam generator.

Referring to FIG. 12, the angle β between the radiating plate 252 of the ultrasonic element segment 250 and the tube sheet 103 of the steam generator 100 is provided to determine the angle of incidence according to Snell's law, which is shown in the following Equation 3 and describes the relationship between the angles of incidence and refraction, wherein the ratio of the sines of the angles of incidence and of refraction is a constant value that depends on media when any waves passes through a boundary between two different isotropic media.

In other words, when a sound wave radiated from the radiating plate 252 has an incidence angle of $\beta_1$ on a boundary between two different media, the sound wave is refracted at an angle of $\beta_2$ at the boundary and is transmitted from one medium to another medium, in which $m_1$ indicates a first medium and $m_2$ indicates a second medium. Further, $c_1$ indicates the traveling speed of the sound wave in the first medium and $c_2$ indicates the traveling speed of the sound wave in the second medium.

$$\frac{\sin\beta_1}{\sin\beta_2} = \frac{\sin\beta}{1} = \frac{c_1}{c_2} = \frac{C_{LW}}{C_R} \qquad \text{Equation 3}$$

$$\beta = \sin^{-1}\left(\frac{C_{LW}}{C_R}\right)$$

As such, in order to apply Snell's law to the segmental ultrasonic cleaning apparatus of the embodiment for removing scales and/or sludge from the top surface of the tube sheet in the steam generator of the nuclear power plant, the segmental ultrasonic cleaning apparatus of the embodiment is based on the principle that surface waves are generated and travel along the surface of the tube sheet of the steam generator when ultrasound waves from the ultrasonic transducer are refracted at angle of $\beta_2$=90 degrees at the surface of the tube sheet 103 (herein, on the boundary). For example, assuming that the steam generator is filled with water as a first medium on the tube sheet and the ultrasound waves radiated from the ultrasonic transducer 251 having the planar radiating plate 252 are complete plane waves, the angle ($\beta$) of incidence of the ultrasound waves may be modeled under conditions that $\beta_1=\beta$, $\beta_2$=90 degrees, the first medium=water, and the second medium=tube sheet (for example, S45C carbon steel), according to Snell's law provided by Equation 3.

Here, $C_{LW}$ indicates a longitudinal wave speed. For example, water has a longitudinal wave speed of 1,480 msec, as is known in the art. Further, $C_R$ indicates a Reyleigh wave speed on the tube sheet of the steam generator made of S45C carbon steel and may be theoretically calculated from mechanical properties of S45C carbon steel.

The angle of incidence may be more accurately obtained by directly measuring and applying $C_{LW}$ and $C_R$ to Snell's law.

When using Equation 3, the angle $\beta$ between the radiating plate 252 of the ultrasonic element segment 250 and the tube sheet 103 of the steam generator 100 is about 30.2 degrees.

Accordingly, when the radiating plates 252 are slanted at an angle of about 30.2 degrees relative to the tube sheet 103 made of S45C and are submerged in water within the steam generator, the ultrasound waves radiated from the radiating plates generate surface waves along the surface of the tube sheet, thereby focusing ultrasound energy only upon the surface of the tube sheet and maximizing cleaning efficiency.

Figure 13:
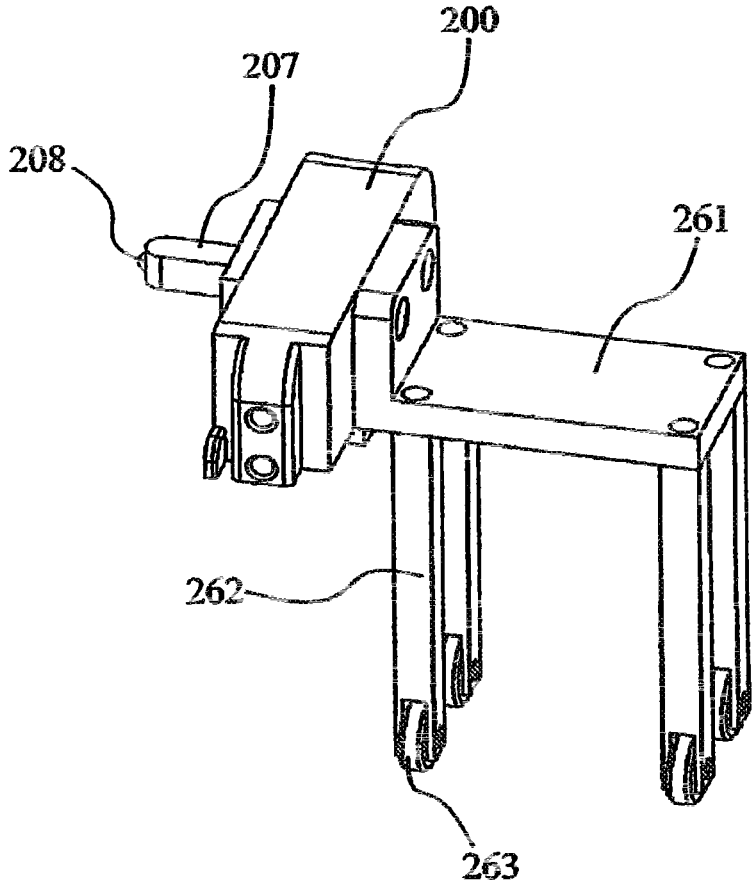
FIG. 13 is a perspective view of a guide rail support segment according to an embodiment of the present invention.

As shown in FIG. 13, the guide rail support segment 260 of the ultrasonic cleaning apparatus according to the embodiment includes the support plate 261 on one side of each guide rail 200. Like the ultrasonic transducer 251, the support plate 261 is mounted on the one side of the guide rail 200 facing the center of the steam generator. The support plate 261 may be coupled to the one side of the guide rail 200 by screw fastening or other methods to facilitate attachment and detachment of the support plate to the guide rail.

As shown in FIG. 13, the support plate 261 includes a vertically extended leg 262 and a wheel 263 secured to a lower side of the leg 262. Here, the leg 262 has the same or greater height than the ultrasonic transducer 251 (see FIG. 11) so that the ultrasonic transducer does not collide with the top surface of the tube sheet.

The wheel 263 of the support plate 261 allows smooth movement on the top surface of the tube sheet in the steam generator.

As shown in FIG. 13, the guide rail 200 may further include the spacer 207 and the ball bearing 208 on the side surface thereof facing the inner wall of the steam generator.

Figure 14:
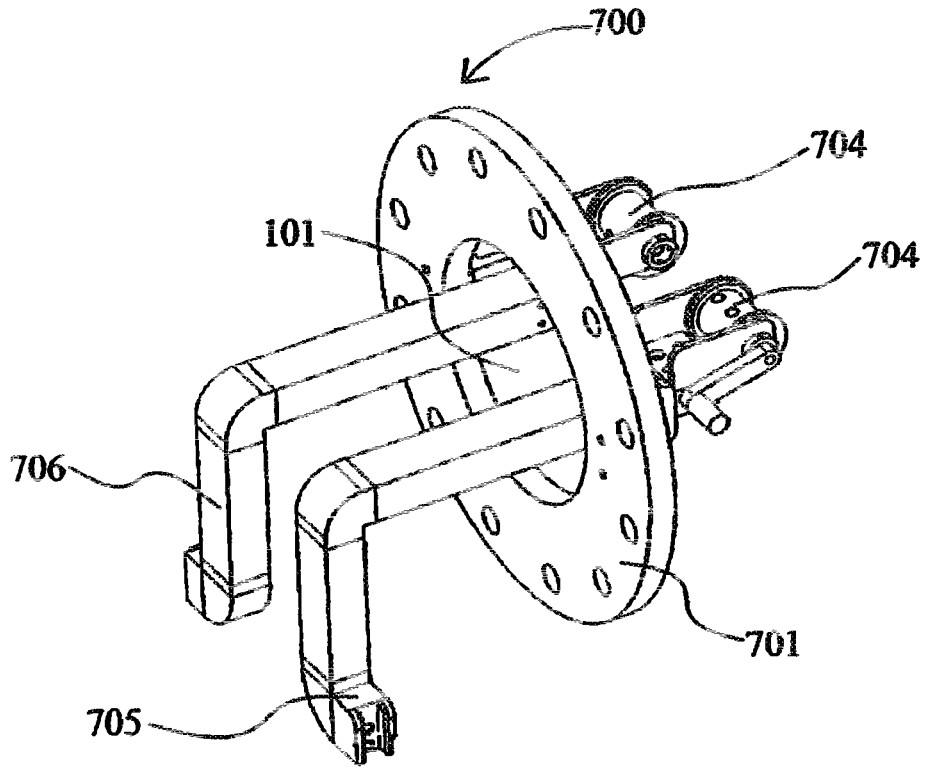
FIG. 14 is a detailed view of a flange unit in a hand hole of the steam generator.

FIG. 14 shows the flange unit installed in the hand hole of the steam generator.

Each of the flange units 700 includes a flange 701 disposed in the hand hole 101, wire pulleys 704 each securing one end of the metal wire, and guide rail couplers 705, 706 connected to the guide rail at either side of the segments arranged in a line.

Either end of each metal wire 300 (see FIGS. 8 and 9) extends through the through-holes 205 of the guide rails 200 and is secured to the wire pulley 704 located outside the steam generator through the guide rail coupler 705 or 706 and the hand hole 101, such that the metal wires 200 can be tightened or loosened by rotating the wire pulleys 704. When the metal wires are tightened, the guide rails 200 are tightly connected to each other like a ring by the metal wires, whereas connection between the guide rails 200 becomes loose to allow slight movement of the guide rails when the metal wires are loosened.

As such, in consideration of cleaning efficiency which typically increases with increasing density of ultrasound energy, the ultrasonic cleaning apparatus according to the embodiment increases the density of ultrasound energy on the surface of the tube sheet in the steam generator to guarantee complete removal of scales and/or sludge deposited on the tube sheet of the steam generator.

With this structure, the ultrasonic cleaning apparatus according to the embodiment may achieve effective removal of scales and/or sludge from the surface of the tube sheet while decomposing the scales and/or sludge via cavitation of ultrasound waves by concentrating the ultrasound waves on the surface of the tube sheet.

Although some embodiments have been provided to illustrate the invention in conjunction with the drawings, it will be apparent to a person having ordinary knowledge in the art that the embodiments are given by way of illustration only, and that various modifications, changes, alterations and equivalent embodiments can be made without departing from the spirit and scope of the invention. The scope of the invention should be limited only by the appended claims.

What is claimed is:

1. An ultrasonic cleaning apparatus for removing scales and/or sludge deposited on a top surface of a tube sheet of a heat exchanger or steam generator, comprising:

guide rails arranged in a line, each of the guide rails having a through-hole formed in a longitudinal direction;

ultrasonic element segments each including an ultrasonic transducer on one side of the guide rails, the ultrasonic transducer including a radiating plate, a magnetostrictive material pack, a magnetic field coil and an angle adjustor;

guide rail support segments each including a support plate disposed on one side of the guide rails, the support plate having a leg and a wheel provided to a lower side of the leg;

a metal wire guided through each through hole of the guide rails; and a flange unit provided to a hand hole of the heat exchanger or steam generator, and including a flange provided to the hand hole, a wire pulley securing one end of the metal wire, and guide rail couplers connected to the guide rails disposed at opposite sides, wherein a plurality of segment groups each comprising at least one of the guide rail support segments and at least one of the ultrasonic element segments, with each radiating plate of the ultrasonic transducer slanted at a predetermined angle relative to the tube sheet, are arranged in a line via the metal wire on the top surface of the tube sheet along an inner wall of the heat exchanger or steam generator, and wherein in each segment group, each ultrasonic element segment is separated by at least one guide rail support segment from the next consecutive ultrasonic element segment, wherein each of the guide rails includes a single projection longitudinally formed on a center of a left side of each the guide rails and a protrusion, and at a right side thereof with two projections longitudinally formed at opposite ends of the right side of the guide rail and a groove formed at a lower side of the two projections to receive the protrusion of another guide rail so as to correspond to the left side of another guide rail linearly arranged next to the guide rail, wherein the two projections of the right side and the single projection and protrusion of the left side of the guide rail are chamfered to have rounded upper edges and the groove is also chamfered to have a rounded upper edge to prevent the guide rails arranged in a line from being bent downward while allowing the guide rails to be easily bent upward, wherein the angle adjuster adjusts an angle β between the radiating plate of the ultrasonic transducer and the tube sheet, wherein the radiating plate of the ultrasonic transducer is slanted towards a center of the top surface of the tube sheet, and wherein the angle β between the radiating plate of the ultrasonic transducer and the tube sheet of the steam generator is defined by the following Equation:

$$\beta = \sin^{-1}\left(\frac{C_{LW}}{C_R}\right)$$

where $C_{Lw}$ indicates a longitudinal wave speed in a medium on the tube sheet of the steam generator and $C_R$ indicates a Reyleigh wave speed on the tube sheet of the steam generator.

2. The apparatus according to claim 1, wherein each of the guide rails further includes a spacer on a side surface thereof facing the inner wall of the steam generator and a ball bearing provided to a distal end of the spacer.

3. The apparatus according to claim 1, wherein each of the guide rails further includes a hook at a lower side thereof.

4. The apparatus according to claim 1, wherein each of the guide rails has an isosceles trapezoidal shape, with right and left sides thereof slanted at opposite angles (A) of the right and left sides of the guide rail, to allow the guide rails to be arranged in a ring shape and parallel to the inner wall of the steam generator.

5. The apparatus according to claim 4, wherein, when the guide rail has an isosceles trapezoid with the opposite angles (A), the guide rail has a length (a) and a width (b) defined by the following Equations:

$$a = r_0 \times 2(\theta[\text{rad}]) = r_0 \times 2\left(\theta[°] \times \frac{\pi}{180}\right), \text{ and}$$

$$b = (r_0 - r_i)\cos\theta$$

where $r_o$ indicates a radius corresponding to the longest distance from a center of the guide rails arranged in the ring shape to a point of the guide rail and $r_i$ indicates an inner radius relating to a thickness of the guide rail.

* * * * *